US006814109B2

(12) United States Patent
Rohret et al.

(10) Patent No.: US 6,814,109 B2
(45) Date of Patent: Nov. 9, 2004

(54) ZERO CLEARANCE ROTOR VALVE FOR PRODUCT FILLING

(75) Inventors: Richard D. Rohret, Colona, IL (US); Gregory C. Vens, Bettendorf, IA (US)

(73) Assignee: Packaging Technologies, Inc., Davenport, IA (US)

( * ) Notice: Subject to any disclaimer, the term of this patent is extended or adjusted under 35 U.S.C. 154(b) by 0 days.

(21) Appl. No.: 10/738,502

(22) Filed: Dec. 17, 2003

(65) Prior Publication Data

US 2004/0129338 A1 Jul. 8, 2004

Related U.S. Application Data

(60) Provisional application No. 60/437,755, filed on Jan. 3, 2003.

(51) Int. Cl.[7] ..... B65B 1/04

(52) U.S. Cl. ..... 141/89; 141/67; 141/301; 222/309

(58) Field of Search ..... 141/67, 86, 89, 141/302, 301, 286; 222/380, 309, 554

(56) References Cited

U.S. PATENT DOCUMENTS 2,850,345 A * 9/1958 Marcuse et al. ..... 225/23
4,860,926 A 8/1989 Juenkersfeld et al.
5,014,882 A * 5/1991 Dennis et al. ..... 222/309
5,019,127 A * 5/1991 Bohm et al. ..... 222/1
6,547,107 B2 * 4/2003 Hiramoto et al. ..... 222/309

FOREIGN PATENT DOCUMENTS

| | | |
|---|---|---|
| DE | 1030759 | 5/1958 |
| DE | 1177510 | 9/1964 |
| DE | 2134207 | 1/1973 |
| DE | 3838462 A1 | 5/1990 |

* cited by examiner

*Primary Examiner*—Steven O. Douglas
(74) *Attorney, Agent, or Firm*—Wood, Herron & Evans, L.L.P.

(57) ABSTRACT

An improved product filling device for filling containers has a zero clearance rotor valve engaging the interior of a rotor valve housing. The rotor has a tapered conical sealing surface engaged with a complimentary conical seating surface in the housing. The position of the rotor allows product to enter a cylinder and be discharged from the cylinder into a container via movement of a piston inside the cylinder. Alternative structures and methods are disclosed.

34 Claims, 6 Drawing Sheets

CF
P
3A
A
C
W1
W2

ZERO CLEARANCE ROTOR VALVE FOR PRODUCT FILLING

CROSS REFERENCE TO RELATED APPLICATIONS

This patent application claims the benefit of provisional patent application Ser. No. 60/437,755 filed Jan. 3, 2003 entitled "ZERO CLEARANCE ROTOR VALVE FOR PRODUCT FILLING."

FIELD OF THE INVENTION

This invention relates generally to filling devices for filling containers; and in particular to a filling device using a zero clearance rotor valve.

BACKGROUND OF THE INVENTION

Food products that are substantially flowable, such as margarine, butter, sour cream, ice cream, yogurt or the like, typically are packaged in individual containers for retail sale and consumer use. Packaging of these types of food products is ordinarily effected with the use of fill pump devices and associated container conveyors that present containers in a continuous, sequential manner to the filling device which is operated to dispense food product to each of the containers.

In such systems, precise control of the filling device is necessary in order to assure that each container receives the desired quantity of product. In practice, such precision can be difficult to achieve due to inherent fluctuations in product consistency and temperature as well as the periodic start-up and shut-down of a filling line which typically complicates accurate filling of the containers.

Existing filling devices or fillers use a cylindrical, plastic rotor in a cylindrical, stainless steel housing to control the amount of product dispensed to each of the containers. Such fillers require a large clearance between the rotor and the stainless steel housing to allow for thermal expansion of the rotor due to changes in ambient or product temperature. This large clearance allows variable amounts of the metered volume of product to leak back into the supply system during dispensing, which leads to inconsistent fill weights. This clearance also allows product to leak from the supply system to the discharge, causing dripping of product between fills.

As can be readily appreciated, the ability to efficiently internally clean the valve assembly of a filling device is a primary concern when dealing with food products. Known valve assemblies of filling devices ordinarily require substantially complete disassembly to effect internal cleaning of the component parts of the valve assembly. Even frequent internal cleaning of the valve assembly may not properly retard bacterial growth and the like, which could lead to contamination of food product passing through the valve assembly. Disassembly of the valve assembly for cleaning purposes is a time consuming process involving substantial interruption of the production line.

Therefore, there is a need for a product filling apparatus which may be cleaned in place without disassembly. There is further a need for a product filling method and apparatus which permits versatile, dependable operation of a filling system while maintaining the appropriate product weight and appearance under a wide variety of operating conditions.

SUMMARY OF THE INVENTION

Products are filled into open containers according to the invention through use of a zero clearance rotor valve combined with a pressure filled metering cylinder. The invention comprises product supply piping, a rotor housing inside which rotates a rotor in zero clearance therewith, a rotor drive mechanism, a metering cylinder inside which moves a piston and a piston drive mechanism. The product supply piping is connected to the top of the rotor housing and the cylinder is connected to one side of the rotor housing. The rotor housing also has an opening on the bottom through which the product flows into the container. The rotor sits inside the rotor housing and has a conical-shaped sealing end with two separate passages or channels cut into it. One passage allows product to flow from the product supply piping into the cylinder. The other passage allows product to flow from the cylinder out to the container when the rotor is shifted (rotated) from a first or prime position to a second or fill position by the rotor drive mechanism. The piston is moved back and forth or reciprocated inside the cylinder by the piston drive mechanism. The location, size and geometry of the passages in the rotor and rotor housing, together with the zero clearance fit, do not allow product to leak from the product supply to either the cylinder or the container.

The conical shape and zero clearance fit of the rotor and rotor housing and the location, size and geometry of the passages in the rotor allow for tight shut off of product. This tight shut off leads to very consistent product fill weights and eliminates leaking of product between fills. The accuracy of the filler is not affected by changes in ambient or product temperature, since the conical sealing surface of the rotor remains in contact with the housing while allowing for expansion.

Moreover, the geometry of the rotor and rotor housing also make this invention easy to clean in place without disassembly. Even though there is operationally a zero clearance between the tapered convex or conical rotor sealing surface of the rotor and its complimentary tapered concave seating surface in the rotor housing, a large clearance between the non-sealing surfaces of the rotor and the rotor housing can be obtained, with a short, backwards movement of the rotor away from the seating surface of the rotor housing. After such movement, all surfaces of the rotor and rotor housing have enough clearance to be cleaned without disassembly. Cleaning solution can flow more easily through the rotor and rotor housing passages, making cleaning faster and more efficient. Cleaning fluid temperatures do not adversely affect rotor motions due to thermal expansion of the components.

The zero clearance sealing surface of the rotor valve also provides an excellent cut-off of product at the end of fill due to the scissor action across the discharge opening in the rotor housing. This allows particles and thick products, such as pieces of fruit, for example, to be cut cleanly without the need for additional cut-off spouting after the rotor valve.

BRIEF DESCRIPTION OF THE DRAWINGS

Details of a zero clearance rotor valve for product filling according to the invention are shown in the attached drawings in which.

DETAILED DESCRIPTION OF THE INVENTION

Figure 1:
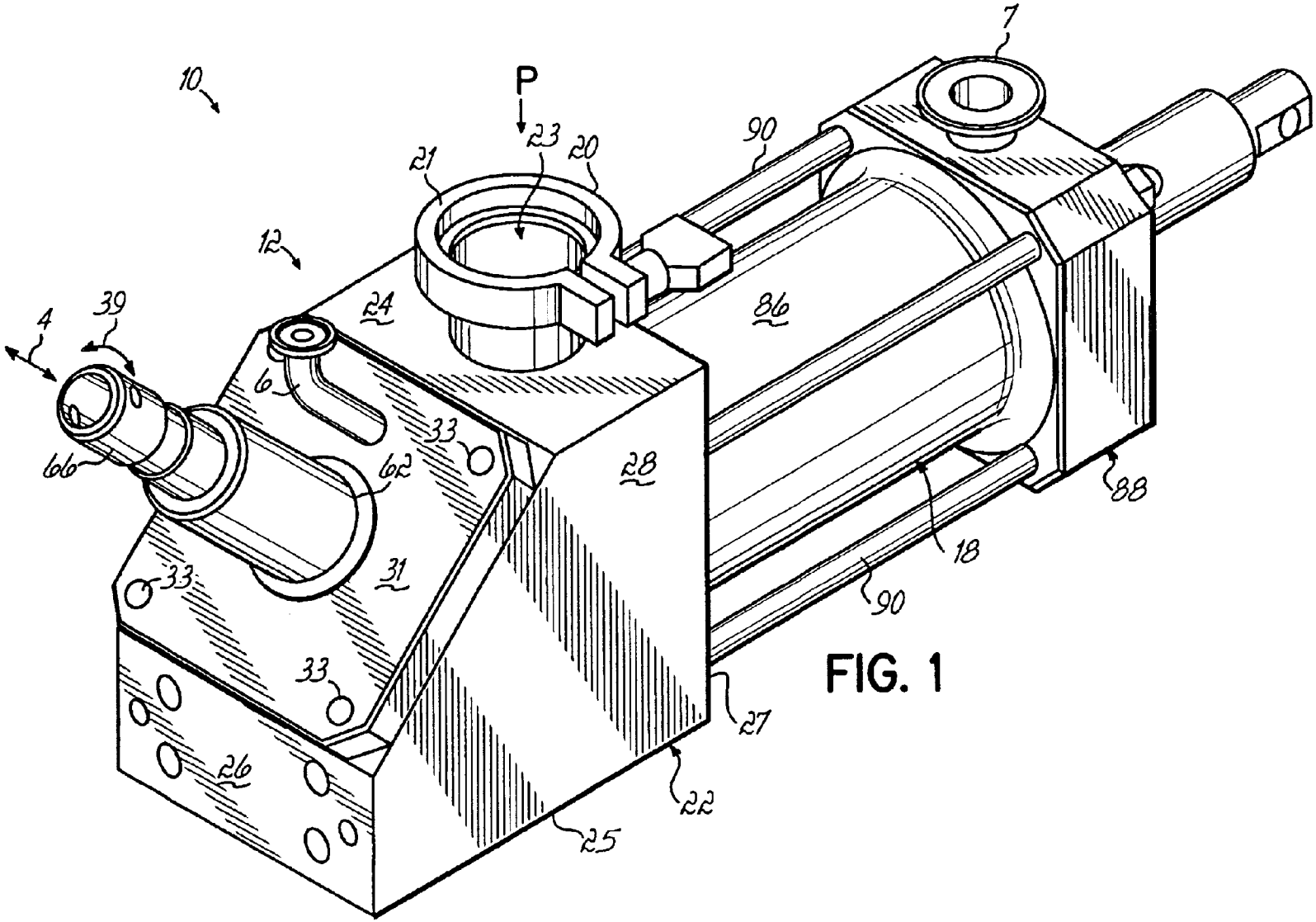
FIG. 1 is a perspective view of the assembled invention.
Figure 2:
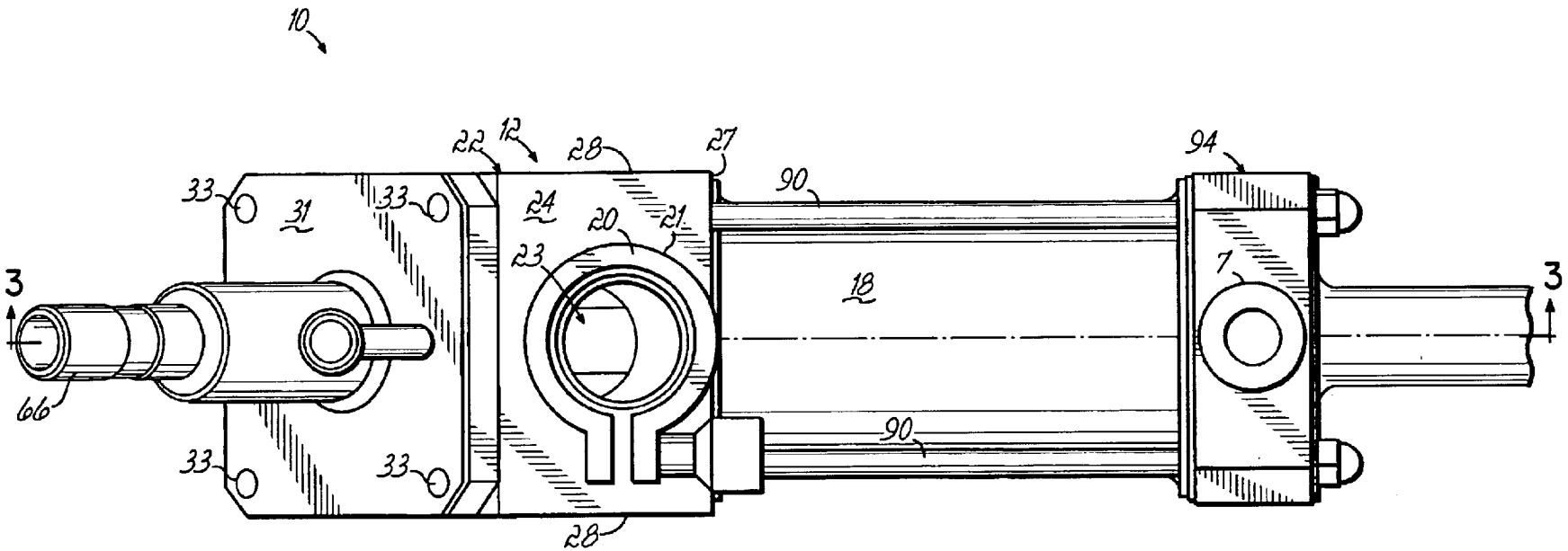
FIG. 2 is a top plan view of the invention of FIG. 1.

Referring to the drawings and particularly to FIG. 1, there is illustrated a filling apparatus or filler 10 in accordance with the present invention. The filler 10 comprises a rotor valve housing 12, a rotor valve or rotor 14 (see FIGS. 6–9) driven by a rotor drive mechanism (not shown) and a piston 16 movable inside a product metering cylinder or chamber 18 via a piston drive mechanism (not shown). Together the piston 16 and product metering cylinder 18 are herein referred to as a product metering means.

A product supply pipe 20 is secured to the rotor valve housing 12 in any suitable manner and extends upwardly from the rotor valve housing 12 as shown in FIG. 1. The product supply pipe 20 has an outer wall 21 which defines a conduit 23 therein. Although one configuration of product supply pipe 20 is illustrated, any other configuration of product supply pipe may be used in accordance with the present invention.

Figure 10:
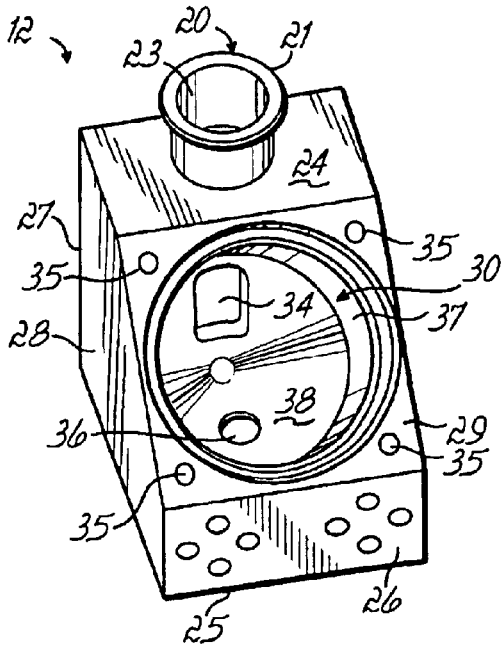
FIG. 10 is a perspective illustration of a rotor housing according to the invention.
Figure 11:
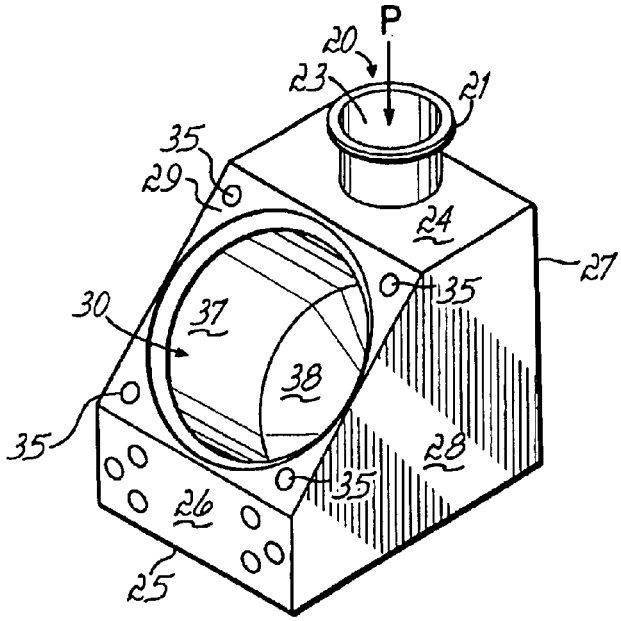
FIG. 11 is another perspective illustration of the rotor housing of the invention.

As best illustrated in FIGS. 10 and 11, the rotor valve housing 12 has a body 22 having a top surface 24, a bottom surface 25, a front surface 26, a rear surface 27, two side surfaces 28 and a mounting surface 29. Although one configuration of rotor valve housing 12 is illustrated, any other configuration of rotor valve housing may be used in accordance with the present invention. Depending on the orientation of the filler 10 of the present invention, the surfaces of the rotor valve housing 12 may be oriented differently than the orientation shown in the drawings and described herein. For example, the front surface 26 of the rotor valve housing 12 may be located behind the surface herein referred to as the rear surface 27. Therefore, the names of the surfaces are merely for identification purposes and are not to be strictly interpreted.

Figures 3, 3A:
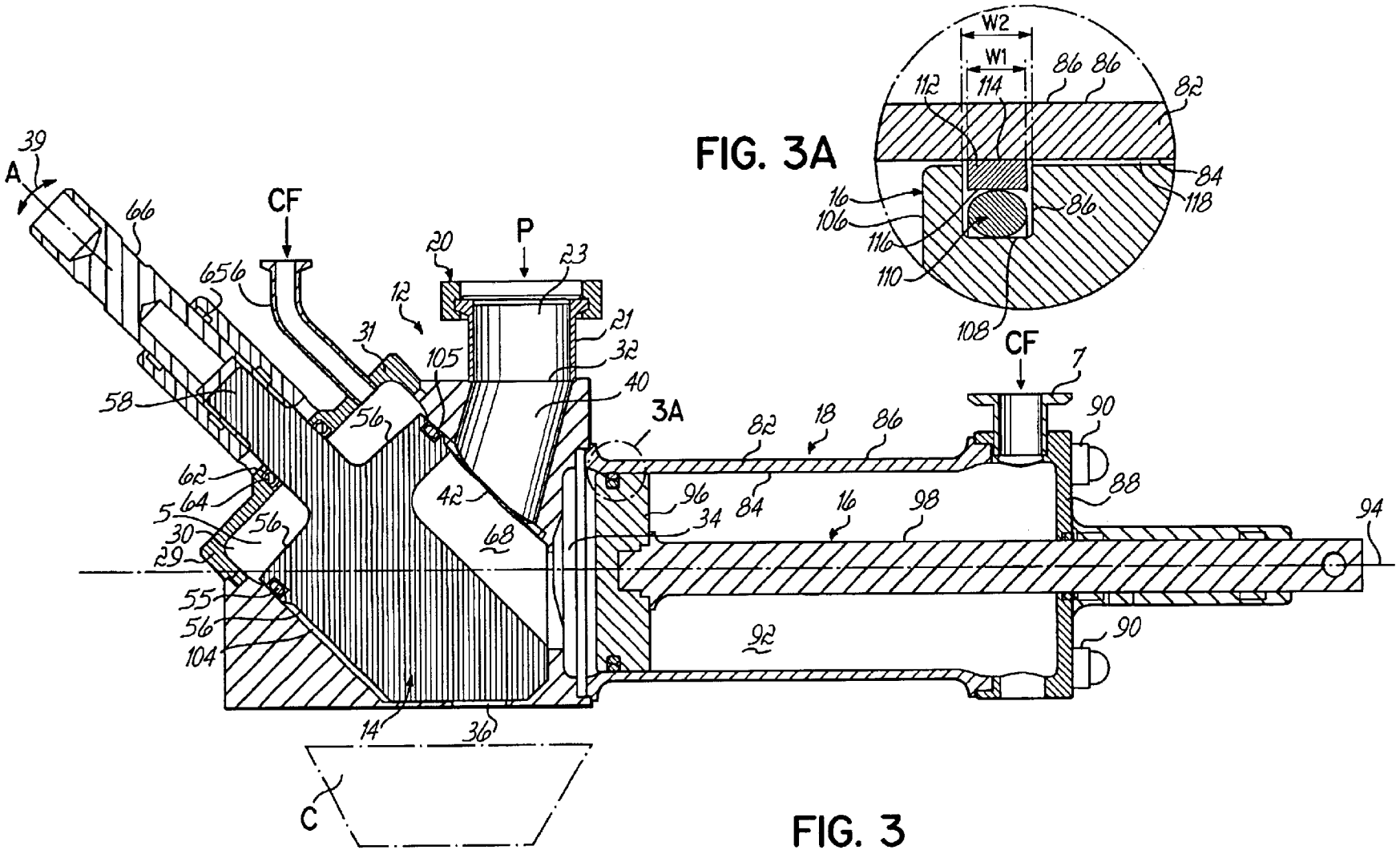
FIG. 3 is a cross-sectional view taken along line 3—3 of FIG. 2, and extended to show the piston end not in FIG. 2.
FIG. 3A is an enlarged view of the circled area 3A of FIG. 3.

As shown in FIG. 3, the body 22 of the rotor valve housing 12 has a cavity 30 therein in which is located the rotor 14. As best illustrated in FIG. 1, a removable cover 31 is removably secured to the body 22 of the rotor valve housing 12 with fasteners 33 which extend into openings 35 in the generally planar mounting surface 29 of the rotor valve housing 12. See FIGS. 10 and 11. The removable cover 31 functions to cover the cavity 30 and enables the rotor 14 to be removed from the cavity 30 for repair or replacement.

As best illustrated in FIG. 3, the rotor valve housing 12 has a product receiving port 32 located in the top surface 24 thereof, a metering cylinder port 34 located in the rear surface 27 thereof and a product discharge port 36 in the bottom surface 25 thereof. As shown in FIGS. 10 and 11, the cavity 30 of the rotor valve housing 12 further has a side surface 37 and a conically-shaped seating surface 38 in which the metering cylinder port 34 and product discharge port 36 are defined. Although the drawings illustrate particular sizes and configurations, the product receiving port 32, a metering cylinder port 34 and product discharge port 36 may be any desired size and any desired shape or configuration.

As illustrated in FIG. 3, the body 22 of the rotor valve housing 12 has a conduit 40 therein which communicates with the conduit 23 of the product supply pipe 20. The conduit 40 extends inwardly from the top surface 24 of the rotor valve housing 12 and terminates at the cavity 30 of the housing body 22. The product receiving port 32 is located at the upper end of the conduit 40 and a product loading port 42 is located at the lower end of the conduit 40. See FIG. 3.

The rotor 14 is located in the cavity 30 of the rotor valve housing 12 and has an outer surface 15. The rotor 14 is rotatable therein via a drive mechanism (not shown) as shown by arrow 39. As best illustrated in FIGS. 6–9, the rotor 14 has a generally conical sealing end portion 44 at the end of a generally cylindrical body portion 46. The generally conical sealing end portion 44 has an outer surface 48 and a generally planar end surface 50, best illustrated in FIGS. 6, 7 and 8. As best seen in FIG. 7, a pair of spaced ridges 52 extend outwardly from the outer surface 54 of the generally cylindrical body portion 46 and define a groove 53 therebetween. As seen in FIG. 3, an O-ring 55 is seated between the ridges 52 in the groove 53. The O-ring 55 is preferably made of silicone but may be made of any suitable material. The generally cylindrical body portion 46 of the rotor 14 terminates in a generally planar intermediate surface 56 best shown in FIG. 9.

The rotor 14 also has a generally cylindrical stem portion 58 having an outer surface 60. This stem portion 58 extends outwardly from the generally cylindrical body portion 46, and more particularly from the intermediate surface 56 of the generally cylindrical body portion 46. As best illustrated in FIG. 3, the stem portion 58 of the rotor 14 extends through an opening 62 in the removable cover 31 of the rotor valve housing 12. An O-ring 64 is located in the removable cover 31 of the rotor valve housing 12. See FIG. 3. The rotor 14 rotates about an axis A due to bearings 65. See FIG. 3. A rotor shaft 66 is secured to the stem portion 58 of the rotor 14. Any suitable drive mechanism (not shown) may be coupled to the rotor shaft 66 in any conventional manner known to those skilled in the art in order to rotate the rotor 14.

Additionally an air cylinder or other lifting mechanism (not shown) may be used to lift or move the rotor 14 during the cleaning process in the direction of arrow 4 without having to disassemble the filler 10 as will be described below. See FIG. 1. The air cylinder or lifting mechanism (not shown) also exerts pressure on the rotor shaft 66 in order to maintain a zero-clearance seal between the outer surface 48 of the generally conical sealing end portion 44 of the rotor 14 and the generally conically-shaped seating surface 38 of the rotor valve housing 12. When the rotor 14 is in its lowered position shown in FIG. 3, the O-ring 55 forms a seal with a contact portion 105 of the body 22 of the housing 12, thereby preventing product from entering an upper portion 5 of the cavity 30 of the housing 12.

Figure 6:
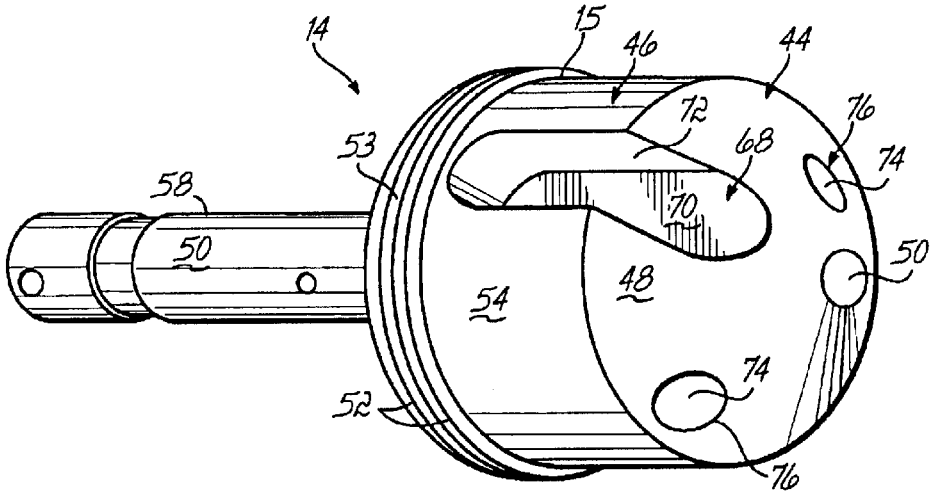
FIGS. 6–9 illustrate the features of the rotor of the invention.
Figure 7:
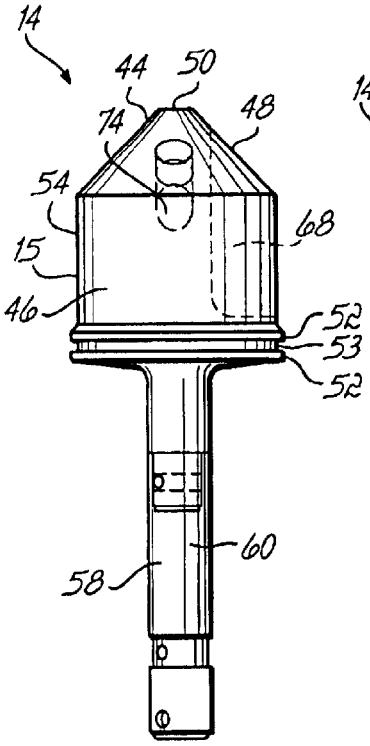
Figure 8:
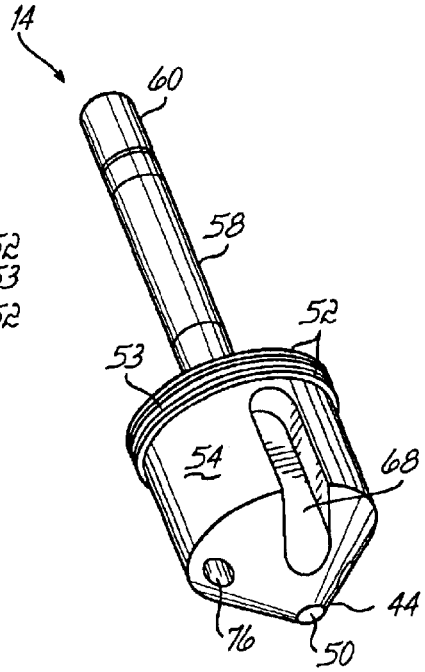
Figure 9:
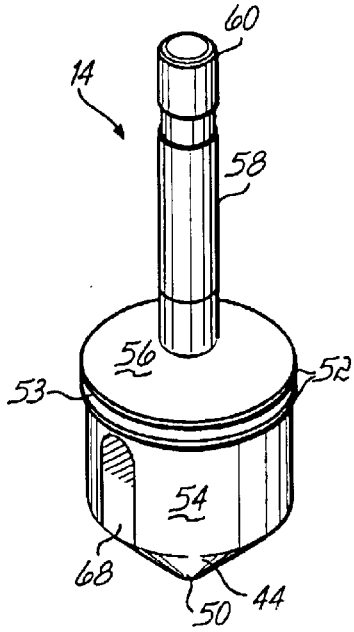

As best illustrated in FIG. 6, the rotor 14 has a filling slot or channel 68 therein which extends inwardly from the outer surface 15 of the rotor 14. This filling slot or channel 68 has a bottom surface 70 and a sidewall surface 72 as best illustrated in FIG. 6. This filling slot, channel or passage 68 allows product P to flow through product supply pipe 20, through the conduit 40 of the rotor valve housing 12 into the interior of the cylinder 18 in a manner described below.

The rotor 14 also has a second passage 74 therethrough, referred hereinafter as internal passage 74. See FIGS. 5–9. As shown in FIG. 6, the internal passage 74 through the rotor 14 comprises two openings 76 at the ends thereof in the outer surface 48 of the end portion 44 of the rotor 14.

Figure 4:
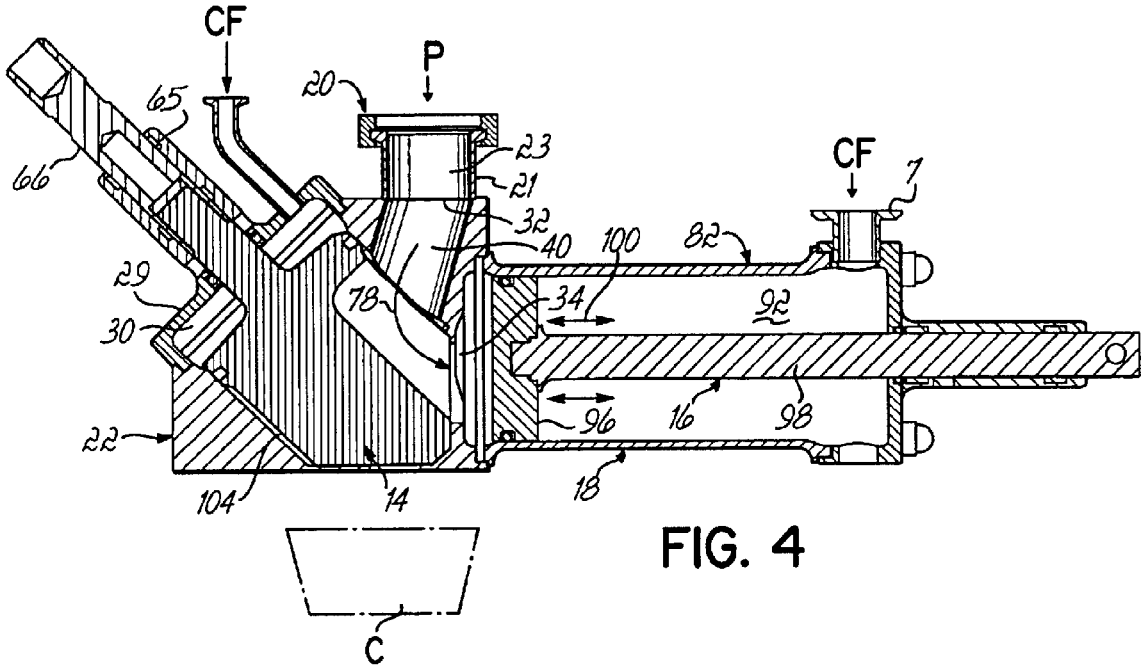
FIG. 4 is a cross-sectional view similar to FIG. 3 illustrating a "prime" operation or "metering fill" of the invention.
Figure 5:
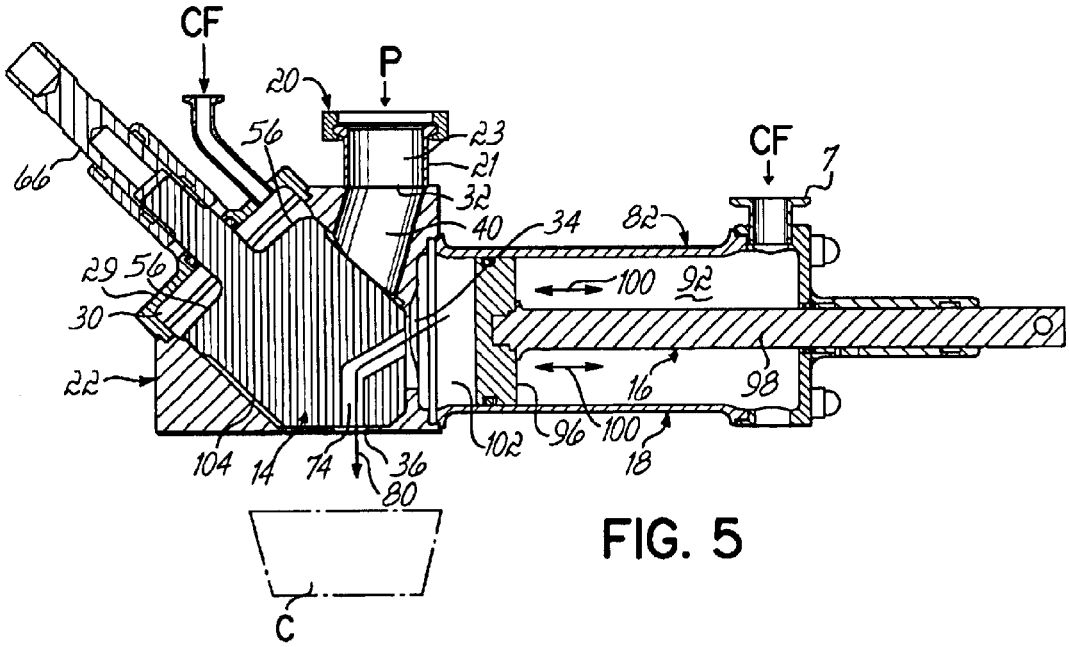
FIG. 5 is a cross-sectional view similar to FIG. 3 but illustrating a filling operation of the invention.

The rotor 14 is rotatable between a first or prime position illustrated in FIG. 4 and a second or fill position illustrated in FIG. 5 by the rotor drive mechanism (not shown). Referring to FIG. 4, in the first or prime position, product P may flow in the direction of arrow 78 through product supply pipe 20, through the conduit 40 of the rotor valve housing 12, out the metering cylinder port 34 and into the interior of the cylinder 18 as the piston 16 moves from left to right. Referring to FIG. 5, in the second or fill position, product P may flow in the direction of arrow 80 from the interior of the cylinder 18, through the metering cylinder port 34, through the internal passage 74 of the rotor, out the product discharge port 36 of the rotor valve housing 12 and into a container C located therebelow as the piston 16 moves from right to left.

As best illustrated in FIGS. 3–5, the product metering cylinder or chamber 18 has a wall 82 having an inner surface 84 and an outer surface 86. The inner surface 84 of the cylinder wall 18 defines an interior 92 of the cylinder 18 having a longitudinal axis 94. At one end the cylinder 18 is joined to the rotor valve housing 12 and at the other end is supported by a cylinder end cap 88. Four tie rods 90 secure the cylinder end cap 88 to the rotor valve housing 12.

Inside the interior 92 of the cylinder 18 the piston 16 moves laterally along the length of the cylinder 18. As shown in FIG. 3, the piston 16 has a piston head 96 and a piston rod 98 secured to the piston head 96 in any conventional manner. The piston 16 is moved back and forth in the interior 92 of the cylinder 18 by a piston drive mechanism (not shown) in the direction of arrows 100. FIGS. 3 and 4 illustrate the piston in a first position in which no product P may enter the interior 92 of the cylinder 18 through the metering cylinder port 34 due to the location of the piston and more particularly, the location of the piston head 96. FIG. 5 illustrates the piston 16 in a second position in which product P has entered a portion 102 of the interior 92 of the cylinder 18 through the metering cylinder port 34 due to the location of the piston and more particularly, the piston head 96. As the piston drive mechanism (not shown) pulls the piston 16 to the right in the drawings, product P is drawn into the portion 102 of the interior 92 of the cylinder 18 through the metering cylinder port 34.

When the rotor 14 is in either the first or second position, the outer surface 48 of the generally conical sealing end portion 44 of the rotor 14 is in contact with the generally conically-shaped seating surface 38 of the rotor valve housing 12. This contact creates a zero-clearance seal therebetween which prevents product from leaking back into the interior 92 of the cylinder 18 through the metering cylinder port 34 or leak through the product discharge port 36 into the container. Thus, the zero-clearance seal between the outer surface 48 of the generally conical sealing end portion 44 of the rotor 14 and the generally conically-shaped seating surface 38 of the rotor valve housing 12 ensures that the container C is filled with the proper amount of fill, not too much or too little.

As shown in FIGS. 4 and 5, the filling process begins by introducing product P into the filler 10 through product supply pipe 20.

Prior to a container C arriving at the filling station, the rotor 14 is positioned in the rotor valve housing 12 in its first or prime position illustrated in FIG. 3. In this position its internal passage 74 is sealed closed and its filling slot or channel 68 is open to both the product supply P and the interior 92 of the product metering cylinder 18 through cylinder port 34. When the rotor 14 is in this first or prime position, the piston 16 is pulled back (to the right in FIG. 4), drawing product P from the product supply (not shown), through product supply pipe 20, through the conduit 40 of the rotor valve housing 12, through the filling slot 68 of the rotor 14, out the metering cylinder port 34 of the rotor valve housing 12 and into the interior 92 of the cylinder 18. The amount of product to be filled into the container C is determined by the length of the stroke of the piston 16. A short stroke of the piston 16 allows less product into the interior 92 of the product metering cylinder 18, while a longer stroke allows more product to be filled into a container C.

When a container C arrives at the filling position, a control circuit energizes a suitable rotor drive mechanism (not shown) which is attached to the rotor shaft 66 and rotates the shaft and the rotor 14 into its second or fill position illustrated in FIG. 5. In this position, the internal passage 74 of rotor 14 is aligned with both the product metering cylinder port 34 and with the spout or product discharge port 36 above the container C. When the rotor 14 is in this second or fill position illustrated in FIG. 5, the filling slot or channel 68, however, is now sealed off from both the product metering cylinder port 34 and with the spout or product discharge port 36 above the container C. A control circuit then initiates the motion of the product piston 16 forward toward the housing 12 (to the left in FIG. 5). As the product piston 16 moves forward toward the housing 12, it pushes product P out of the interior 92 of the product cylinder 18, through the product metering cylinder port 34, through the rotor's internal passage 74, through product discharge port 36 and into container C. When the product piston 16 reaches the farthest forward position, the interior 92 of the product metering cylinder 18 is emptied and the motion of the piston stops.

After the product piston 16 completes the forward stroke, the control circuit de-energizes a solenoid valve (not shown) which rotates the rotor shaft 66 and the rotor 14 back into its first or prime position illustrated in FIG. 4. When the product piston 16 moves backward away from the housing 12, fresh product is drawn into the interior 92 of the product cylinder 18, ready for the next fill cycle.

The filler 10 of the present invention is specifically designed to enable the filler 10 to be cleaned with a cleaning solution or fluid without disassembling the filler 10. The cleaning process is similar to the filling process in that any suitable cleaning solution may be supplied through the product supply pipe 20 and pass through the same passages as the product, the rotor 14 and piston 16 operating in the same fashion. During cleaning, rotor 14 can be reciprocated axially in bore or cavity 30 of rotor housing 12, so that its outer conical surface 48 is reciprocated toward and away from complimentary surface 38 of the cavity 30 of the housing 12. The cleaning solution is not filled into containers, but is ejected through product discharge port 34 and collected in a drain trough located below the spouts and recirculated back into the filler.

In addition to the simulated filling action, the rotor 14 raises and lowers axially (see arrow 4) to allow cleaning solution to flow onto a gap 104, best illustrated in FIG. 3. The gap 104 exists between the outer surface 54 of the body portion 46 of the rotor 14 and the complimentary side surface 37 of the cavity 30 the housing 12. More particularly, as the rotor 14 is raised from a lowered or non-cleaning position shown in the figures to a raised or cleaning position, the O-ring 55 seated in the groove 53 is raised above a contact portion 105 of the body 22 of the housing 12 and the outer surface 48 of the generally conical sealing end portion 44 of the rotor 14 is raised off the generally conically-shaped seating surface 38 of the rotor valve housing 12, thereby breaking the zero-clearance seal. See FIG. 3. When the rotor 14 is in its lowered or non-cleaning position, the O-ring 55 forms a zero clearance seal between itself and the contact portion 105 of the body 22 of the housing 12, thereby preventing cleaning fluid from passing into the gap 104 between the outer surface 15 of the rotor and the body 22 of the housing 12. In addition, when the rotor 14 is in its lowered or non-cleaning position the outer surface 48 of the generally conical sealing end portion 44 of the rotor 14 contacts the generally conically-shaped seating surface 38 of the rotor valve housing 12, thereby creating a zero-clearance seal. When the rotor 14 is in its raised or cleaning position the O-ring 55 does not contact the contact portion 105 of the body 22 of the housing 12, thereby breaking the zero clearance seal and allowing cleaning fluid to enter the gap 104 between the outer surface 15 of the rotor and the body 22 of the housing 12 for cleaning purposes. With the rotor 14 in this raised position, the O-ring 55 is located in an upper portion 5 of the cavity 30 of the housing 12 which has a larger diameter than the portion of the cavity 30 proximate the contact portion 105 of the body 22. Therefore, when cleaning fluid (CF) is introduced into the upper portion 5 of the cavity 30 of the housing via spout 6 extending upwardly from the removable cover 29 of the housing 12, cleaning fluid may flow into the gap 104 to clean the exposed surfaces of the rotor 14 and the exposed surfaces of the housing 12. In addition, cleaning fluid may flow between the outer surface 48 of the generally conical sealing end portion 44 of the rotor 14 and the generally conically-shaped seating surface 38 of the rotor valve housing 12.

At the initiation of the cleaning process, the rotor 14 is raised to its raised, cleaning position as described above. Additionally, the piston 16 is moved away from the housing 12 (moved to the right in FIG. 3) so that cleaning fluid may be introduced through a spout 7 extending upwardly from the product metering cylinder 18 inside the piston head 96. With the piston 16 is this position, cleaning fluid or solution CF may be introduced through the spout 7 into the interior 92 of the metering cylinder 18 for cleaning purposes. Movement of the piston 16 enhances the cleaning process in a manner described below.

As shown in FIG. 3A, the piston 16 has an outer surface 106 in which is cut an O-ring groove 108. Inside the O-ring groove 108 reside a silicone O-ring 110 having a generally oval shape. Outside the O-ring 110 is a ultra high molecular weight polyethylene sealing ring 112 having an outer surface 114 in contact with the inner surface 84 of the cylinder wall 82 and an inner surface 116 in contact with the O-ring 110. The polyethylene ring 112 has a width W1 slightly shorter than the width W2 of the O-ring groove 108 in order to allow cleaning fluid or cleaning solution to clean the interior of the O-ring groove 108 including the exterior surface of the O-ring 110. During the cleaning process, cleaning fluid flows through a gap 118 between the outer surface 106 of the piston 16, more particularly the outer surface of the piston head 96 and the inner surface 84 of the cylinder wall 82. The location and operation of the ultra high molecular weight polyethylene ring 112 prevents direct contact between the O-ring 110 and the inner surface 84 of the metering cylinder wall 82, which prolongs the useful life of the O-ring 110. Due to the high temperature of the cleaning solution, direct contact between an O-ring and the inner surface of a metering cylinder wall may damage the O-ring as the piston moves. The present invention eliminates this possibility by providing a sealing ring 112 between the O-ring and the inner surface 84 of the metering cylinder wall 82.

The rotor housing 12 and metering cylinder 18 can be configured to different sizes to match fill size requirements and the product characteristics such as particulates in the product. Also, multiple fillers can be attached together with a common drive source for multiple fills at once.

Different spouts can be attached to the discharge port of the housing 12 to suit different products. For example, a "shower head" style spout can be added to reduce foaming and splashing with low viscosity products.

Different supply piping systems can be used with the filler. A pressurized system in conjunction with a compensator can be used for products that have steady flow requirements, such as margarine and ice cream. A non-pressurized hopper system can be used for a wide variety of products.

The zero clearance rotor valve can also be used in a two-way valve for other types of filling. The rotor and rotor housing can be configured to simply open and close the discharge port to a supply source. The fill size can then be controlled by means of a steady state flow and timed on/off signals, on/off signals from a flow meter, on/of signals from a weigh scale under the container, etc. The rotor and housing would still provide all of the advantages listed above.

Although the rotor 14 and rotor housing 12 along with all the other components of the present invention are preferably made of stainless steel, any one of the components of the filler 10 may be made of other materials.

These and other alterations and modifications will become readily apparent to those of ordinary skill in the art without departing from the scope of the invention and applicant intends to be bound only by the claims appended hereto.

We claim:

1. A product filler comprising:

a rotor valve housing;

a metering means;

a valve rotor;

the rotor valve housing and valve rotor having respective complimentary and tapered seating and sealing surfaces in operable engagement and a channel communicating at the tapered sealing surface of the valve rotor for connecting, in one position of valve rotor, the metering means to a filler discharge, and in another position of the valve rotor sealing the metering means from the filler discharge.

2. A filler as in claim 1 wherein the tapered surfaces are conically-shaped.

3. A filler as in claim 1 wherein the tapered surfaces include a convex conical shape on the rotor and a concave conical shape in the housing.

4. A filler as in claim 1 including a second channel in the rotor operably and selectively connecting the metering means to a source of product when the rotor is in the other position.

5. A filler as in claim 1 wherein the rotor is axially reciprocable in the housing.

6. A filler as in claim 1 wherein said seating and sealing surfaces are in a zero clearance relationship with each other.

7. A product filler comprising:

a product metering cylinder;

a rotor valve housing having a product receiving port, a metering cylinder port and a product discharge port, the housing having a conically-shaped seating surface in which the metering cylinder port and the product discharge port are defined; and a valve rotor with a conically-shaped sealing surface oriented in engagement with the seating surface of the valve housing for passing product from a product supply to the product metering cylinder in one position and in another position for passing product from the product metering cylinder to the product discharge port.

8. A filler as in claim 7 wherein the rotary valve has a passage with at least two passage ports disposed so that one passage port is in the conically-shaped sealing surface and is aligned with the product discharge port when another passage port in the conically-shaped sealing surface is aligned with the metering cylinder port.

9. A product filler comprising:

a product metering cylinder;

a rotor valve housing having a conically-shaped seating surface in which a metering cylinder port and a product discharge port are defined; and a valve rotor with a conically-shaped end portion having an outer surface, the outer surface of the end portion of the rotor being in contact with the conically-shaped seating surface of the rotor valve housing due to pressure exerted on the valve rotor, wherein product may pass from a product supply to the product metering cylinder through the metering cylinder port when the valve rotor is in one position and product may pass from the product metering cylinder to a container through the product discharge port when the valve rotor is in another position.

10. A valve rotor for use in a filling device, the valve rotor comprising:

a generally cylindrical body portion;

a generally conical sealing end portion at one end of the generally cylindrical body portion;

a stem portion extending outwardly from the other end of the generally cylindrical body portion, the stem portion being adapted to be joined to a drive mechanism;

a filling slot extending inwardly from an outer surface of the valve rotor; and an internal passage extending through the generally conical sealing end portion of the valve rotor.

11. The valve rotor of claim 10 wherein the internal passage has two openings at the ends thereof in the generally conical sealing end portion of the valve rotor.

12. The valve rotor of claim 10 wherein the generally cylindrical body portion has two ridges extending outwardly from an outer surface of the valve rotor between which is defined a groove.

13. A product filler comprising:

a rotor valve housing;

a valve rotor in said housing;

a product supply for delivering product to said housing;

a metering chamber operably connected to said housing;

a discharge port in said housing;

a passage in said valve rotor for passing product to said metering chamber in one position of said rotor;

a passage in said valve rotor for passing product to said discharge part in another position of said rotor; and complimentary convex and concave sealing surfaces on said valve rotor and valve housing in zero clearance orientation with respect to each other in both said positions.

14. A product filler as in claim 13 wherein said convex and concave surfaces are each conical.

15. A product filler as in claim 13 including means to eject product from said metering chamber.

16. A product filler as in claim 13 wherein said valve rotor has a third position wherein said sealing surfaces are spaced apart in said housing for cleaning.

17. A product filler comprising:

a rotor valve housing having a discharge port and a metering cylinder port;

a rotatable valve rotor in said housing;

a product supply for delivering product to said housing;

a metering cylinder operably connected to said housing, said metering cylinder having a metering cylinder wall;

a piston movable in said metering cylinder, said piston having a piston head having a groove therein;

a sealing ring in said groove; and an O-ring in said groove inside said sealing ring wherein as said piston moves inside said metering cylinder, said O-ring does not contact said metering cylinder wall.

18. The product filler of claim 17 wherein said sealing ring is made of polyethylene.

19. A method of dispensing food product into a container using a filling device comprising a rotor valve housing, a rotor valve rotatable by a rotor drive mechanism, a cylinder having an interior in which moves a piston powered by a piston drive mechanism, the method comprising:

positioning the rotor valve in a first position in a cavity in the rotor valve housing such that a generally conical sealing surface of the rotor valve contacts a generally conical seating surface of the rotor valve housing;

rotating the rotor valve from the first position in which product may flow into the interior of the cylinder to a second position in which product may flow from the interior of the cylinder through an internal passage in the rotor valve and out a product discharge port in the rotor valve housing into a container upon movement of the piston inside the interior of the cylinder.

20. The method of claim 19 wherein the rotor valve is rotated by a drive mechanism located outside the rotor valve housing.

21. The method of claim 19 wherein the piston is moved by a drive mechanism located outside the cylinder.

22. The method of claim 19 further comprising lifting the rotor valve from the first position to a raised position in the cavity in the rotor valve housing for cleaning purposes.

23. A method of dispensing food product into a container using a filling device comprising a rotor valve housing, a rotor valve rotatable by a rotor drive mechanism, a piston powered by a piston drive mechanism movable inside a cylinder, the method comprising:

positioning the rotor valve in a first position in a cavity in the rotor valve housing;

passing product through a conduit in the rotor valve housing and a channel in the rotor valve into the interior of the cylinder;

rotating the rotor valve from the first position to a second position;

moving the piston inside the interior of the cylinder such that product flows from the interior of the cylinder through an internal passage in the rotor valve and out a product discharge port in the rotor valve housing into a container.

24. The method of claim 23 wherein the rotor valve is rotated by a drive mechanism located outside the rotor valve housing.

25. The method of claim 23 wherein the piston is moved by a drive mechanism located outside the cylinder.

26. The method of claim 23 further comprising lifting the rotor valve from the first position to a raised position in the cavity in the rotor valve housing for cleaning purposes.

27. The product filler of claim 17 wherein said sealing ring contacts said metering cylinder wall.

28. The product filler of claim 17 wherein said O-ring is made of silicone.

29. The product filler of claim 17 wherein said O-ring has a generally oval shape.

30. The product filler of claim 17 wherein said sealing ring has a width and said O-ring having a width, said width of said O-ring being greater than the width of said sealing ring.

31. A product filler comprising:

a rotor valve housing;

a metering cylinder operably connected to said rotor valve housing, said metering cylinder having a metering cylinder wall;

a piston movable in said metering cylinder, said piston having a piston head having a groove therein;

a valve rotor;

the rotor valve housing and valve rotor having respective complimentary and tapered seating and sealing surfaces in operable engagement and a channel communicating at the tapered sealing surface of the valve rotor for connecting, in one position of the valve rotor, the metering cylinder to a filler discharge, and in another position of the valve rotor sealing the metering cylinder from the filler discharge;

an O-ring in said groove; and a sealing ring in said groove between said O-ring and said metering cylinder wall wherein said sealing ring contacts said metering cylinder wall.

32. The product filler of claim 31 wherein said O-ring is made of silicone.

33. The product filler of claim 31 wherein said O-ring has a generally oval shape.

34. The product filler of claim 31 wherein said sealing ring has a width and said O-ring having a width, said width of said O-ring being greater than the width of said sealing ring.

* * * * *

UNITED STATES PATENT AND TRADEMARK OFFICE

CERTIFICATE OF CORRECTION

PATENT NO. : 6,814,109 B2 
DATED : November 9, 2004
INVENTOR(S) : Richard D. Rohret and Gregory C. Vens It is certified that error appears in the above-identified patent and that said Letters Patent is hereby corrected as shown below:

Column 6,
Line 62, change "surface 37 of the cavity 30 the housing 12. More particularly," to
-- surface 37 of the cavity 30 of the housing 12. More particularly, --.

Column 7,
Line 45, change "groove 108 reside a silicone O-ring 100 having a generally" to
-- groove 108 resides a silicone O-ring 100 having a generally --.

Column 8,
Line 21, change "signals, on/off signals from a flow meter, on/of signals from" to
-- signals, on/off signals from a flow meter, on/off signals from --.

Column 9,
Line 59, change "discharge part in another position of said rotor; and" to
-- discharge port in another position of said rotor; and --.

Signed and Sealed this

Fourteenth Day of June, 2005

JON W. DUDAS
*Director of the United States Patent and Trademark Office*